US010246107B2

(12) United States Patent
Meyer et al.

(10) Patent No.: US 10,246,107 B2
(45) Date of Patent: Apr. 2, 2019

(54) CHASSIS FOR A RAIL VEHICLE

(71) Applicant: SIEMENS MOBILITY GMBH, Munich (DE)

(72) Inventors: Heiko Meyer, Creussen (DE); Hans Juergen Maerkl, Stadtbergen (DE); Philipp Scholle, Aachen (DE)

( * ) Notice: Subject to any disclaimer, the term of this patent is extended or adjusted under 35 U.S.C. 154(b) by 275 days.

(21) Appl. No.: 15/037,945

(22) PCT Filed: Nov. 25, 2014

(86) PCT No.: PCT/EP2014/075475
§ 371 (c)(1),
(2) Date: May 19, 2016

(87) PCT Pub. No.: WO2015/078839
PCT Pub. Date: Jun. 4, 2015

(65) Prior Publication Data

US 2016/0304103 A1 Oct. 20, 2016

(30) Foreign Application Priority Data

Nov. 29, 2013 (DE) ..... 10 2013 224 582

(51) Int. Cl.
*B61F 5/32* (2006.01)
*B61F 5/38* (2006.01)

(52) U.S. Cl.
CPC ..... *B61F 5/32* (2013.01); *B61F 5/325* (2013.01); *B61F 5/38* (2013.01); *B61F 5/386* (2013.01)

(58) Field of Classification Search
CPC .... B61F 5/32; B61F 5/38; B61F 5/325; B61F 5/386
See application file for complete search history.

(56) References Cited

U.S. PATENT DOCUMENTS 4,285,280 A * 8/1981 Smith ..... B61F 5/38 105/168
4,537,138 A * 8/1985 Bullock ..... B61F 5/38 105/165

(Continued)

FOREIGN PATENT DOCUMENTS

CN 201914271 U * 8/2011 ..... B61F 5/32
CN 201914271 U 8/2011

(Continued)

*Primary Examiner* — Robert J McCarry, Jr.
*Assistant Examiner* — Scott A Browne
(74) *Attorney, Agent, or Firm* — Laurence Greenberg; Werner Stemer; Ralph Locher

(57) ABSTRACT

A chassis for a rail vehicle, in particular for a locomotive. A chassis frame is supported on first and second wheel sets and one triangular link per wheel set on both sides of the chassis for horizontally guiding the axle of the wheel set. An A-arm is hinged to one of two axle bearings by a wheel set-side bearing and by two frame-side bearings. The latter have elastomer bushings with a constant longitudinal and transverse rigidity. The former have hydraulic bushings with constant transverse rigidity and variable longitudinal rigidity. The bearings of each A-arm are arranged on the corners of a horizontal isosceles triangle. The tip of the triangle forms the wheel set-side bearing and the base forms the frame-side bearings. This resolves the conflicting objectives between dynamic running behaviors of the chassis when cornering and the driving stability when traveling straight ahead at a high speed.

7 Claims, 5 Drawing Sheets

(56) References Cited

U.S. PATENT DOCUMENTS

| | | | | |
|---|---|---|---|---|
| 2003/0230213 | A1* | 12/2003 | Schaller | B61F 3/06 105/168 |
| 2017/0166224 | A1* | 6/2017 | Meyer | B61F 5/325 |

FOREIGN PATENT DOCUMENTS

| | | | | |
|---|---|---|---|---|
| DE | 4424884 | A1 | 1/1996 | |
| DE | 69920527 | T2 | 9/2005 | |
| DE | 102010033811 | A1 * | 2/2012 | B61F 5/308 |
| DE | 102010033811 | A1 | 2/2012 | |
| EP | 1228937 | A1 * | 8/2002 | B61F 5/386 |
| EP | 1228937 | B1 | 9/2004 | |
| EP | 1457706 | A1 | 9/2004 | |
| FR | 2747166 | A1 | 10/1997 | |
| WO | 2008031624 | A1 | 3/2008 | |

* cited by examiner

CHASSIS FOR A RAIL VEHICLE

BACKGROUND OF THE INVENTION

Field of the Invention

The invention relates to a chassis for a rail vehicle, in particular for a locomotive. The chassis has a chassis frame, which is supported at least on a first wheel set and a second wheel set, and an A-arm per wheel on both sides of the chassis for horizontally guiding the axle of the wheel set. An A-arm is hinged to one of two axle bearings of a wheel set by a wheel-set-side bearing, and to the chassis frame by two frame-side bearings.

There exists in chassis for rail vehicles a fundamental conflict of objectives between dynamic running behavior when traveling on curves and driving stability when traveling straight ahead at a high speed. This conflict of objectives has been known for a long time in the history of rail technology and there have been many different attempts to resolve it. This conflict of objectives has again been the focus of attention just recently, due to a tightening of the conditions for accessing the rail network by infrastructure operators in Europe and in the light of ongoing discussion surrounding the introduction of wear-dependent charges for use of the rail network.

The examined German application DE 44 24 884 A1 discloses a running gear for rail vehicles having at least two wheel sets. Each wheel set is arranged on both sides via linkages between axle bearings and vehicle frame or chassis frame. Each wheel set linkage is constructed as an A-arm, wherein the joints are formed by mountings with allocated bolts in the corner regions. Two joints are arranged on one part and a further joint is arranged on another part. The joint that defines the transverse rigidity of the axle has low horizontal rigidity as a soft mounting, while the other two joints have high horizontal rigidity as hard mountings. The disadvantage of this is that the transverse rigidity of the axle is constant irrespective of the speed of travel and thus an unsatisfactory compromise must be accepted between radial positioning of the wheel sets when traveling on curves and driving stability when traveling straight ahead at speed.

The translation DE 699 20 527 T2 of patent specification EP 1 228 937 B1 shows a device for guiding the axles of a rail vehicle chassis. The device has at least one elastically hydraulic articulation, which is connected along a horizontal axis between a housing of each mounted axle and the chassis frame. The articulation is operated by active control of the main undercarriage of the chassis for the radial positioning of the axles relative to a curve in the track and acts as a hydraulic cylinder. This solution is accompanied by the disadvantage of a costly, actively controlled, hydraulic wheel set steering system.

An axle guide bearing, particularly for rail vehicles, is known from patent application EP 1 457 706 A1. It comprises a link pin pivotable in a transverse direction and at least one spring element, arranged between the link pin and the link lug of the axle guide. The spring element comprises a hydraulic bushing, which has an outer and an inner housing, which surround one another at a radial distance, in order to form an annular gap. In the annular gap, a rubber-elastic element is provided, which at least partially delimits at least two diametrically opposed chambers, which are filled with a hydraulic fluid and are connected to one another via an overflow duct. The rigidity characteristic of the bearing is influenced by the geometry of the rubber-elastic element and the geometric design of the chambers. The disclosed axle guide is rigidly connected in its central region to the wheel set bearing housing and is coupled at its end located opposite the link lug via a shock absorber to the chassis of the rail vehicle.

The examined German application DE 10 2010 033 811 A1 discloses a hydro-bearing, consisting of a metallic inner bolt coated with an elastomer such that, by means of a vulcanized, two-part intermediate sleeve in a half-shell form, two symmetrical, diametrically opposing chambers are formed, which are used to accommodate hydraulic damping fluid. An outer sleeve is mounted there over. The elastomer allows a relative radial displacement of the inner bolt to the outer sleeve, which—depending on the characteristic curve—influences the spring-action movement of the bearing as a function of shock absorption or rigidity. By the additional insertion of sealing lips on the chambers between outer and intermediate sleeve, a hermetic and permanent sealing of the chambers is achieved.

Publication FR 2 747 166 A1 discloses a hydraulic anti-oscillation support sleeve for suspensions of motor vehicles. It has two rigid tubes, one of which is enclosed by the other. The tubes are connected to one another via an elastomer element, forming two sealed, diametrically opposing chambers, which are connected to one another by a narrow duct. The chambers and the duct are filled with a fluid. The chambers are partially defined by a flexible sealing membrane, which separates them from an air chamber.

BRIEF SUMMARY OF THE INVENTION

The object of the invention is to provide a vehicle of the type described in the introduction, which resolves the conflict of objectives between dynamic running behavior when traveling on curves and driving stability when traveling straight ahead at a high speed.

The object is achieved according to the invention by a generic-type chassis with the features as claimed.

The chassis for a rail vehicle, in particular for a locomotive, accordingly has a chassis frame which is supported on at least a first wheel set and a second wheel set. For each wheel set the chassis has an A-arm on each side for the horizontal guidance of the wheel set. In this case an A-arm is hinged to one of two axle bearings of a wheel set by a wheel-set-side bearing and to the chassis frame by two frame-side bearings. According to the invention the frame-side bearings have elastomer bushings with a constant longitudinal and transverse rigidity and the wheel-set-side bearings have hydraulic bushings with constant transverse rigidity and variable longitudinal rigidity. The bearings of each A-arm are arranged respectively on the corners of a horizontally aligned isosceles triangle, the tip of the triangle forming the wheel-set-side bearing and the base of the triangle forming the frame-side bearings. By arranging the bearings so that they are distributed symmetrically in the longitudinal direction on the corners of an isosceles triangle, a particularly high transverse rigidity of the A-arm can be obtained, which is determined by the properties of the elastomer in the bearings. The variable longitudinal rigidity of the hydraulic bearing is dependent on the frequency of the guidance forces to be transmitted, which are excited by the wave travel of a wheel set as a function of the speed. The hydraulic bearing has a high longitudinal rigidity at high excitation frequencies and a low longitudinal rigidity at low excitation frequencies. Travel on curves by the rail vehicle is characterized by low excitation frequencies of the guidance forces to be transmitted by the A-arm, so that the resulting low longitudinal rigidity of the hydraulic bearing allows a radial positioning of the first and second wheel set. When the rail vehicle is traveling straight ahead at a high speed, guidance forces with high frequencies are excited so that the resulting high longitudinal rigidity of the hydraulic bearing results in a high driving stability of the chassis.

In an advantageous embodiment of the inventive chassis, a frame-side bearing has a bearing bolt pushing vertically through the elastomer bushing, with holes running horizontally through said bearing bolt, through which are guided fixing means for connecting the bearing to the chassis frame above and below the elastomer bushing. A secure fixing of the frame-side bearing on the chassis frame is thereby achieved by two screw connections running in the longitudinal direction, the A-arm having two degrees of freedom for rotations about the vertically running bearing bolt.

In a preferred embodiment of the inventive chassis a wheel-set-side bearing has a bearing bolt pushing vertically through the hydraulic bushing with a hole running vertically through said bearing bolt, through which fixing means for connecting the bearing to the axle bearing of the wheel set are guided coaxially through the hydraulic bushing. Both link pins and fixing means designed as a screw connection have a common vertical axis here, the link pin sitting in corresponding mountings on the axle bearing of the wheel set above and below the hydraulic bushing.

In an advantageous embodiment of the inventive chassis, each hydraulic bushing has an externally located fluid chamber in the longitudinal direction and an internally located fluid chamber in the longitudinal direction, which are arranged opposite one another in the longitudinal direction and are filled with a hydraulic fluid, each fluid chamber being connected to a fluid duct through which hydraulic fluid can flow into or out of the fluid chamber, the longitudinal rigidity of the hydraulic bushing varying as a function of the excitation frequency of fluid flows forced into or out of a fluid chamber by wheel set guiding forces. The flow resistance which the fluid duct imposes on a fluid flow of the hydraulic fluid determines how quickly hydraulic fluid can flow out of a fluid chamber pressurized by guidance forces, or how quickly hydraulic fluid under excess pressure can flow out of a fluid duct into a fluid chamber. The diameter and length of the fluid duct play a vital role in this. Internally located and externally located refer here to the longitudinal direction, which is defined as running parallel to the direction of travel or rail direction. In the longitudinal direction, the first and second wheel set are arranged one after the other—in other words, on both sides of the center of a chassis—an internally located fluid chamber being arranged facing the center of the chassis and an externally located fluid chamber being arranged facing away from the center of the chassis.

Each hydraulic bushing of the inventive chassis preferably has an internal fluid duct, via which the externally located fluid chamber and the internally located fluid chamber are hydraulically coupled to the same hydraulic bushing. The hydraulic coupling facilitates an exchange of fluid between the fluid chambers of each hydraulic bushing via the internal fluid duct, i.e. the fluid duct running inside a hydraulic bushing. Its flow resistance and the transverse accelerations of wheel set and chassis frame determine the frequency-dependent longitudinal rigidity of the hydraulic bushing. The wheel set guidance thus responds dynamically softly at low wave travel frequencies of the wheel set, so that the first and second wheel set can be positioned radially to the track curve. At high wave travel frequencies, such as occur at higher travel speeds on essentially straight tracks with very large curve radii, the longitudinal rigidity of the wheel-set-side bearing and thus the driving stability of the chassis increases.

Alternatively, hydraulic bushings arranged on the same chassis side of the inventive chassis are connected via external fluid ducts such that the externally located fluid chamber of the first wheel set is hydraulically coupled to the internally located fluid chamber of the second wheel set and the internally located fluid chamber of the first wheel set is hydraulically coupled to the externally located fluid chamber of the second wheel set. Via external fluid ducts, designed as rigid lines or flexible tubes, fluid chambers can be hydraulically coupled to different hydraulic bushings. The coupling is effected symmetrically in the longitudinal direction on both sides of the chassis. The steering of the first and second wheel set also takes place purely passively here. The coupling favors the radial positioning of the wheel sets in the track curve and guarantees the high longitudinal rigidity required when starting up at high tractive force or when braking. When the forces move in the same direction on both wheel-set-side bearings, for example when the wheel sets are starting up or braking, there is no exchange of fluid between the coupled fluid chambers—the response of the wheel-set-side bearings is hard. When the forces move in opposing directions, for example when traveling on curves, hydraulic fluid is exchanged between the coupled fluid chambers—the response of the wheel-set-side bearings is soft. As a result of the hydraulic coupling between the first and the second wheel set and the equal hydraulic pressure in the coupled fluid chambers, the wheel sets are positioned radially to the track curve.

In a preferred embodiment of the inventive chassis, a pressure sensor is assigned to each fluid chamber coupled via a fluid duct, which pressure sensor responds when the pressure prevailing in the hydraulic fluid falls below a predefinable threshold value, the pressure sensors being connected individually and/or serially to a pressure monitoring device, and the pressure monitoring device being designed for the purpose of transmitting a warning signal to a central control device of the rail vehicle, when individual and/or all pressure sensors respond. This makes diagnosis possible in the event of a failure of the hydraulic system. The pressure sensors measure the pressure prevailing in coupled fluid chambers, a switch being closed as soon as the pressure falls below a threshold value. When pressure sensors are connected individually to the pressure monitoring device, they can be used to establish separately for each hydraulic bushing whether there is a critical fall in pressure. When pressure sensors are serially connected to the pressure monitoring device, they can be used to establish whether there is a critical fall in pressure in the hydraulic bushings overall. Depending on the finding, a warning signal about the critical fall in pressure can be output to a central control device of the rail vehicle. This enables the operating safety of the rail vehicle to be ensured.

In another advantageous embodiment of the inventive chassis a third wheel set is arranged between the first wheel set and the second wheel set. The invention, which has hitherto been described for chassis with two axles, is also applicable for chassis with three axes, where a third, inner wheel set is arranged between the first and the second wheel set as outer wheel sets. While the radial positioning of the outer wheel sets is accomplished by inventive A-arms, the third, inner wheel set already occupies a radial position.

BRIEF DESCRIPTION OF THE SEVERAL VIEWS OF THE DRAWING

Other features and advantages of the inventive chassis will emerge from the following description with the help of the drawings. These are schematic illustrations in which.

DESCRIPTION OF THE INVENTION

Figure 1:
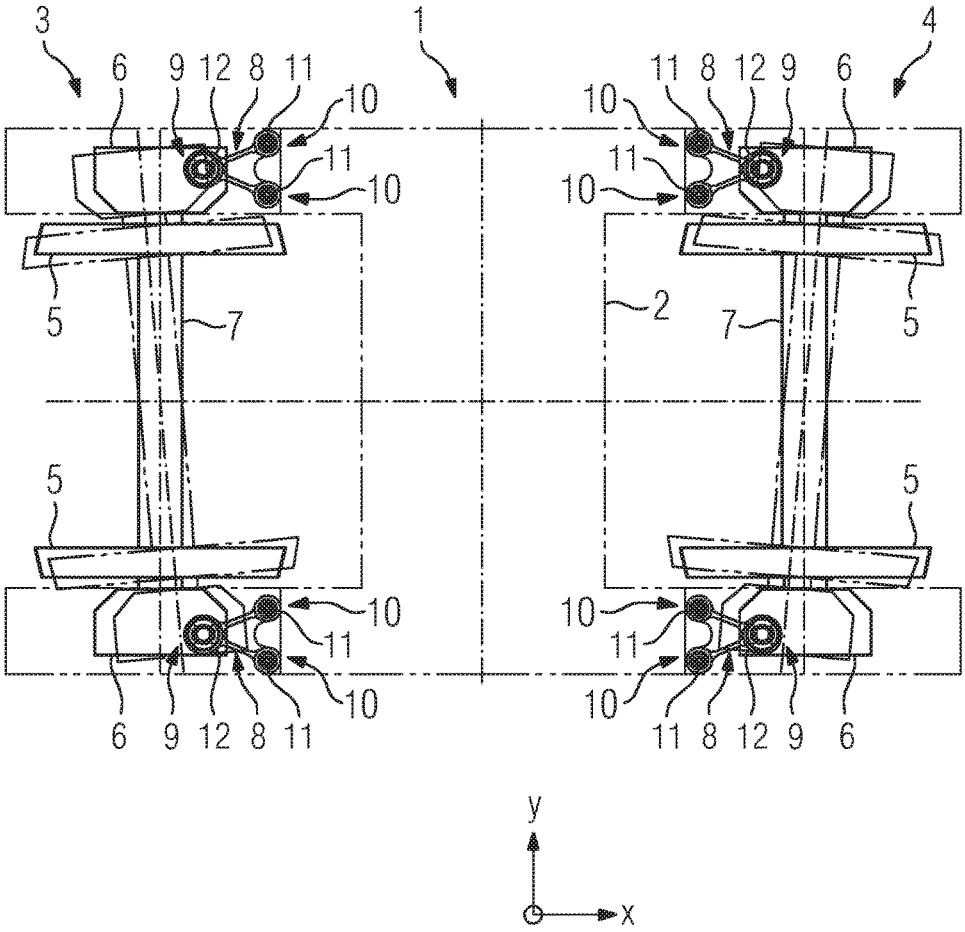
FIG. 1 shows a two-axle exemplary embodiment of the inventive chassis viewed from above.
Figure 2:
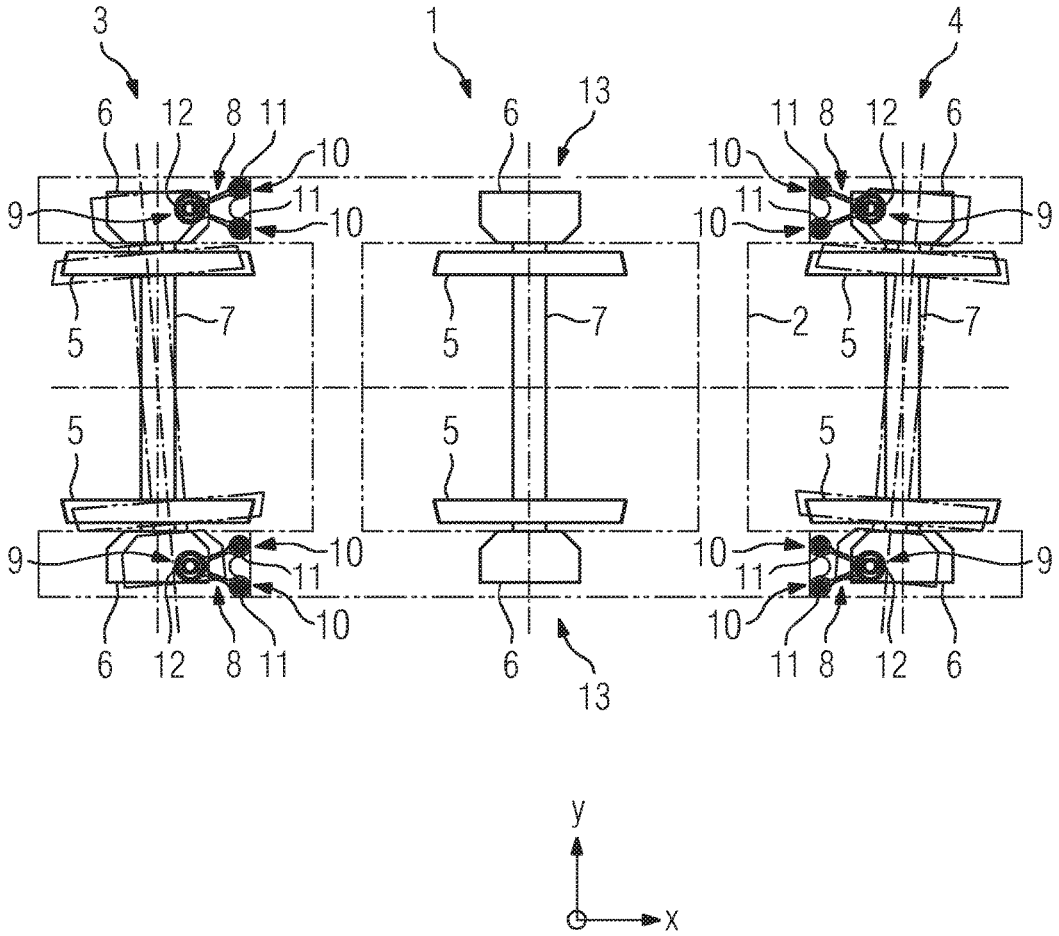
FIG. 2 shows a three-axle exemplary embodiment of the inventive chassis viewed from above.

An inventive chassis 1, on which a body of a rail vehicle (not illustrated), for example a locomotive, is flexibly supported so that it pivots about a vertical axis, has a chassis frame 2 as shown in FIG. 1 and FIG. 2. The chassis frame 2 is supported at least on a first wheel set 3 and a second wheel set 4, which are referred to below jointly as wheel sets 3 and 4. Each of the wheel sets 3 and 4 has two track wheels 5, which are connected by a wheel axle 7 held in two axle bearings 6. For horizontally guiding the axle of the wheel sets 3 and 4, these wheel sets are each hinged to the chassis frame 2 on both sides of the chassis via A-arms 8. Each A-arm 8 is hinged to an axle bearing 6 by a wheel-set-side bearing 9 and to the chassis frame 2 by two frame-side bearings 10. The frame-side bearings 9 have elastomer bushings 11 with constant longitudinal and transverse rigidity and the wheel-set-side bearings 10 have hydraulic bushings with constant transverse rigidity and variable longitudinal rigidity. The bearings 9 and 10 of each A-arm 8 are arranged respectively on the corners of a horizontally aligned isosceles triangle, the tip of the triangle forming the wheel-set-side bearing 9 and the base of the triangle forming the frame-side bearings 10. Unlike the two-axle chassis 1 shown in FIG. 1, a three-axle chassis 1 according to FIG. 2 has a third wheel set 13, which is arranged in the longitudinal direction X between the first wheel set 3 and the second wheel set 4 and is connected to the chassis frame 2. When the rail vehicle travels on a curve the outer wheel sets 3 and 4 are aligned radially to the track curve, as indicated by a dashed/dotted line in FIG. 1 and FIG. 2. For this purpose, the hydraulic bushings 12 have a low longitudinal rigidity at low travel speeds, while at high travel speeds on mainly straight tracks they have a high longitudinal rigidity, which leads to high driving stability.

Figure 3:
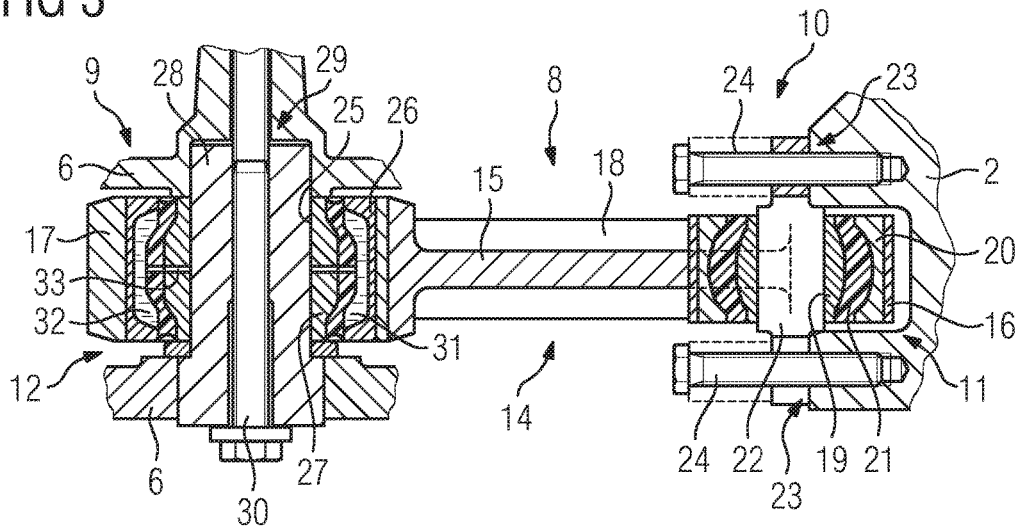
FIG. 3 shows a partially cut away side view of an A-arm.
Figure 4:
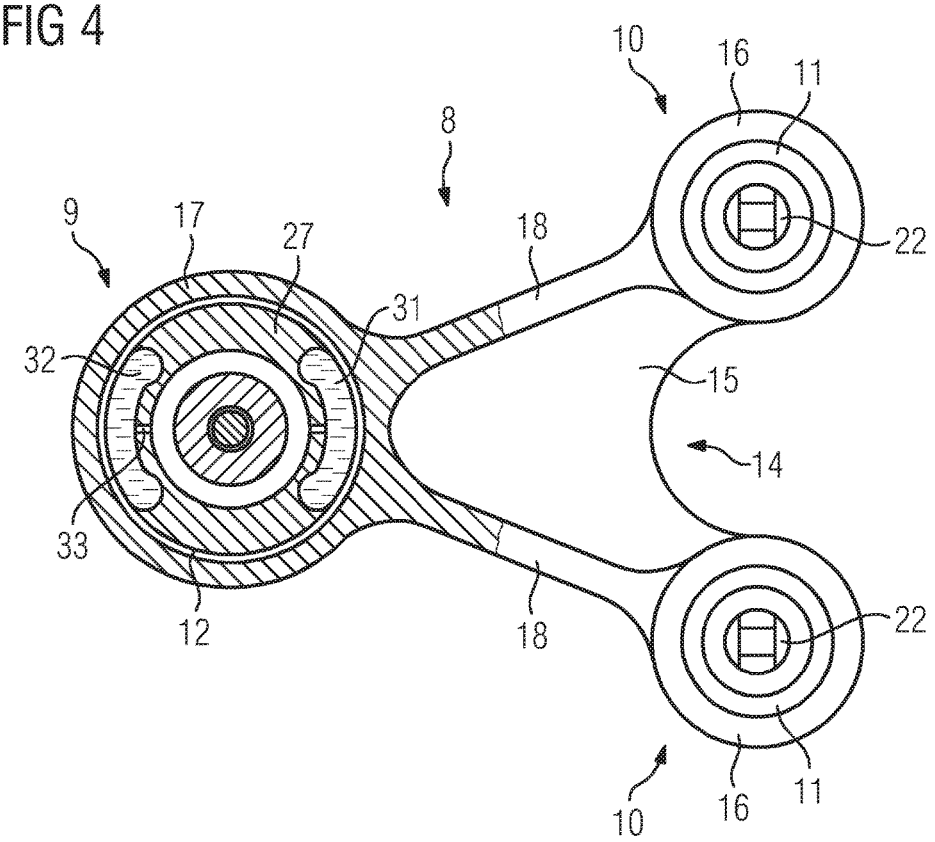
FIG. 4 shows the A-arm according to FIG. 3, viewed from above, FIG. 5 graphically illustrates the frequency dependency of the longitudinal rigidity of a hydraulic bushing of the A-arm.

According to FIG. 3 and FIG. 4, each of the A-arms 8 has a linkage body 14, which has a horizontally extending connection wall 15 via which two smaller link lugs 16 for mounting the elastomer bushings 11 and a larger link lug 17 for mounting the hydraulic bushing 12 are connected to one another. The linkage body 14 may be designed as a cast, forged or milled part. Vertically protruding connecting webs 18 are optionally molded on the two side edges of the connection wall 15 connecting the larger link lug 17 to the smaller link lugs 16. Each elastomer bushing 11 has an inner bearing shell 19, an outer bearing shell 20 and an elastomer ring 21 embedded between them. Due to the rotationally symmetrical design of the elastomer bushing 11 it has a constant rigidity in the longitudinal direction X and in the transverse direction Y. The outer bearing shell 20 sits in the smaller link lug 16, while the inner bearing shell 19 is penetrated by a vertically aligned bearing bolt 22. At both ends of the bearing bolt 22 protruding from the inner bearing shell 19, two flat contact surfaces are carved out, lying parallel to one another, in the region of which a horizontal hole 23 running through is incorporated at each end. The through holes 23 are used for guiding the fixing means 24 for connecting the frame-side bearings 10 to the chassis frame 2 above and below the elastomer bushings 11. Each hydraulic bushing 12 likewise has an inner bearing shell 25, an outer bearing shell 26 and an annular elastomer element 27 embedded between them. The outer bearing shell 26 sits in the larger link lug 17, while the inner bearing shell 25 is penetrated vertically by a bearing bolt 28. The bearing bolt 28 has a vertical hole 29 running through it, through which fixing means 30 are guided for connecting the wheel-set-side bearing 9 to the axle bearing 6 coaxially through the hydraulic bushing 12. The elastomer element 27 and the outer bearing shell 26 form two segment-shaped cavities opposite one another in the longitudinal direction X, whereof the cavity facing the elastomer bushings 11 forms an internally located fluid chamber 31 and the cavity facing away from the elastomer bushings 11 forms an externally located fluid chamber 32. The fluid chambers 31 and 32 are connected to one another by an internal fluid duct 33 and are filled with a hydraulic fluid. This causes the internally and externally located fluid chambers 31 and 32 to be hydraulically coupled such that hydraulic fluid, which flows out of one of the fluid chambers 31 or 32 as a result of external pressurization, flows into the other fluid chamber 32 or 31. The external pressurization originates from guidance forces between the axle bearings 6 of the wheel sets 3 and 4 and the chassis frame 2, which are transmitted by the A-arm 8 and can lead to a fluid exchange between the fluid chambers 31 and 32 in the hydraulic bushings 12.

Figure 5:
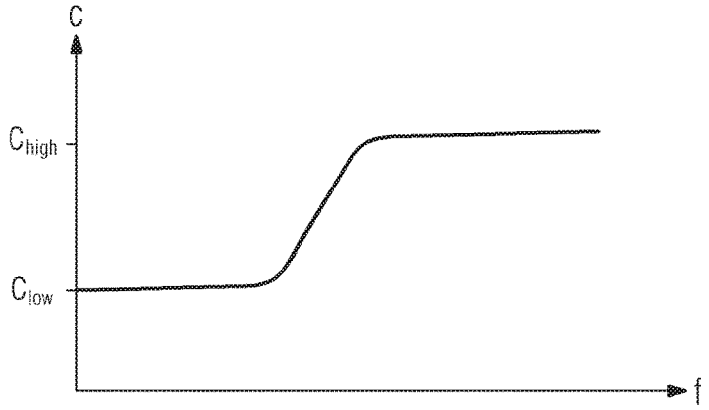

The frequency f, with which transverse accelerations are externally excited in the elastomer element 27 by the wave travel of the wheel sets 3 and 4, is crucial for the longitudinal rigidity c of the hydraulic bushings 12. As well as high transverse rigidity the hydraulic bushings 12 have a variable, excitation-frequency-dependent longitudinal rigidity c, the course of which is indicated in FIG. 5. Low frequencies f, which occur at low travel speeds of the rail vehicle, for example when traveling on curves, are accompanied by low longitudinal rigidity $c_{low}$; the wheel-set-side bearings 9 are then soft, so that a radial positioning of the wheel sets 3 and 4 in the track curve is possible by fluid exchange. At high travel speeds of the rail vehicle when driving straight ahead, high excitation frequencies f occur, which are accompanied by a high longitudinal rigidity $c_{high}$; the wheel-set-side bearings 9 are then hard, whereby the driving stability of the chassis 1 is increased. The speed of the fluid exchange between the fluid chambers 31 and 32 is dependent on the flow resistance of the internal fluid duct 33, which is essentially determined by its course and cross-sectional area.

Figure 6:
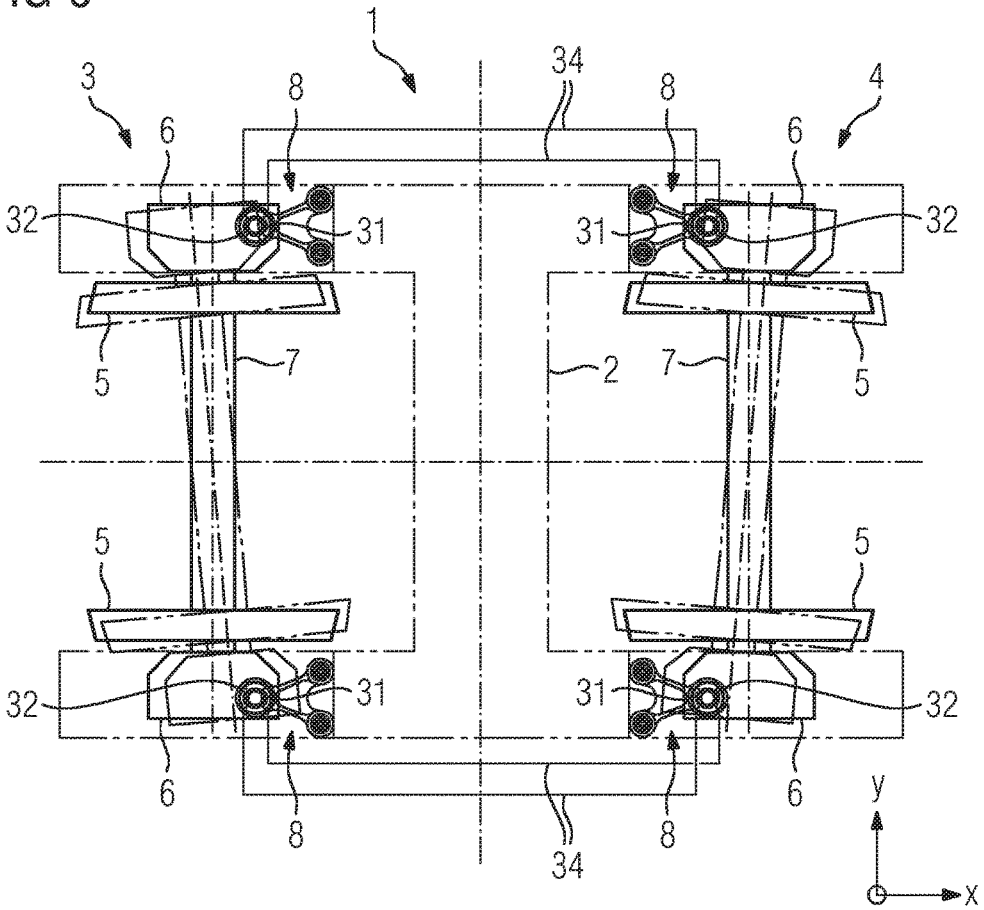
FIG. 6 shows a further two-axle exemplary embodiment of the inventive chassis viewed from above.

The fluid chambers 31 and 32 are not connected internally in a hydraulic bushing 12 in the embodiment according to FIG. 6, but via external fluid ducts 34, which can be designed as a rigid hydraulic line or as flexible hydraulic tubes. The hydraulic bushings 12 arranged on the same chassis side are connected here via two external fluid ducts 34 such that the externally located fluid chamber 32 of the first wheel set 3 is hydraulically coupled to the internally located fluid chamber 31 of the second wheel set 4 and the internally located fluid chamber 31 of the first wheel set 3 to the externally located fluid chamber 32 of the second wheel set 4. The coupling is affected symmetrically in the longitudinal direction on both sides of the chassis, whereby the radial positioning of the wheel sets 3 and 4 in the track curve is favored and the high longitudinal rigidity c required when starting up with high tractive force or when braking is guaranteed. During start-up or braking of the wheel sets 3 and 4 the forces moving in the same direction are applied to the wheel-set-side bearings 9, so that there is no exchange of fluid between the coupled fluid chambers 31 and 32—the response of the bearing 9 is hard. When traveling on curves, forces moving in opposing directions are applied, so that hydraulic fluid is exchanged between the coupled fluid chambers 32 located internally and externally and the soft bearing response may lead to a radial positioning of the wheel sets 3 and 4. The advantage of this concept consists in a good transmission of pull-push forces.

Figure 7:
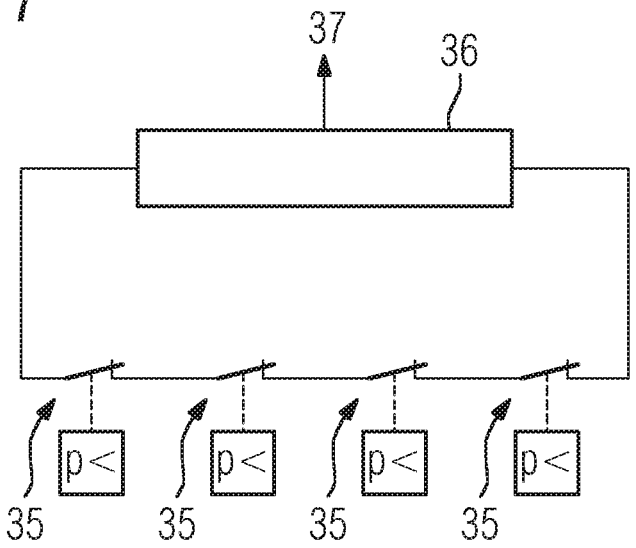
FIG. 7 shows a first circuit of pressure sensors for transmitting signals to a pressure monitoring device.
Figure 8:
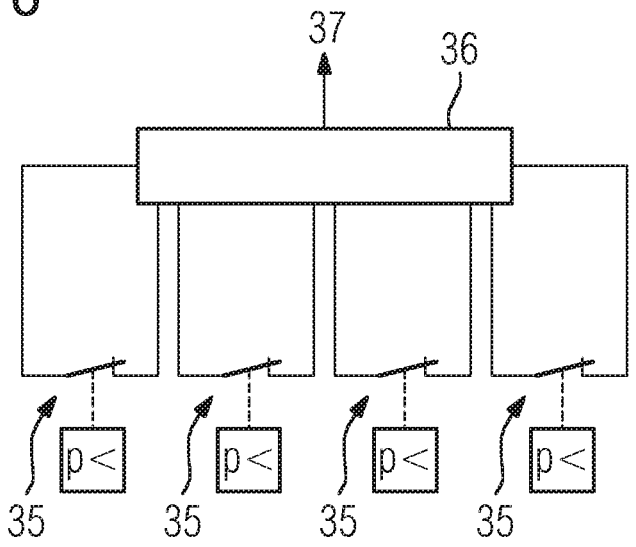
FIG. 8 shows a second circuit of pressure sensors for transmitting signals to a pressure monitoring device.

For monitoring of the hydraulic pressure p, according to FIG. 7 and FIG. 8 a pressure sensor 35 is assigned to each pair of fluid chambers 31 and 32 coupled via a fluid duct 33 or 34. The pressure sensor 35 responds when the pressure p prevailing in the hydraulic fluid falls below a pre definable threshold value. When the pressure sensors 35 are connected serially as per FIG. 7, a pressure monitoring device 36 establishes whether there is a critical fall in pressure in the coupled fluid chambers 31 or 32. If the pressure sensors 35 are connected individually to the pressure monitoring device 36 as per FIG. 6, it is possible to establish separately for each pair of coupled fluid chambers 31 and 32 whether there is a critical fall in pressure. The pressure monitoring device 36 is designed to transmit a warning signal to a central control device 37 of the rail vehicle if individual and/or all pressure sensors 35 respond. This makes diagnosis possible in the event of a failure of the hydraulic system. Depending on the finding, a warning signal about the critical fall in pressure can be output to a central control device 37 of the rail vehicle. This enables the operating safety of the rail vehicle to be ensured.

The invention claimed is:

1. A chassis for a rail vehicle having wheel sets with axles and axle bearings, the chassis comprising:

a chassis frame supported at least on a first wheel set and a second wheel set of the rail vehicle;

an A-arm disposed on each wheel set on both sides of the chassis for horizontally guiding the axle of the wheel set;

a wheel-set-side bearing hinging a respective said A-arm to one of two axle bearings of a wheel set and two frame-side bearings hinging said A-arm to said chassis frame;

said frame-side bearings having elastomer bushings with constant longitudinal and transverse rigidity and said wheel-set-side bearings having hydraulic bushings with constant transverse rigidity and variable longitudinal rigidity;

said frame-side and wheel-set-side bearings of each said A-arm being arranged on corners of a horizontally aligned isosceles triangle, the triangle having a tip forming said wheel-set-side bearing and a base forming said frame-side bearings, each of said hydraulic bushings having an externally located fluid chamber in a longitudinal direction and an internally located fluid chamber in the longitudinal direction, which are arranged opposite one another in the longitudinal direction and are filled with a hydraulic fluid, each of said fluid chambers being connected to a fluid duct through which hydraulic fluid can flow into or out of the fluid chamber, wherein the longitudinal rigidity of said hydraulic bushing varies as a function of an excitation frequency of fluid flows forced into or out of a fluid chamber by wheel set guiding forces;

said hydraulic bushings arranged on a same chassis side are connected via external fluid ducts such that said externally located fluid chamber of said first wheel set is hydraulically coupled to said internally located fluid chamber of said second wheel set and said internally located fluid chamber of said first wheel set is hydraulically coupled to said externally located fluid chamber of said second wheel set;

a pressure sensor assigned to and coupled with each said fluid chamber via a fluid duct, said pressure sensor responding when a pressure prevailing in the hydraulic fluid falls below a pre-defined threshold value, said pressure sensors being connected individually and/or serially to a pressure monitoring device, and the pressure monitoring device is configured for transmitting a warning signal to a central control device of the rail vehicle when one or all of said pressure sensors respond.

2. The chassis according to claim 1, wherein a frame-side bearing includes a bearing bolt pushing vertically through said elastomer bushing, said bearing bolt having holes formed therein horizontally through said bearing bolt, for guiding there through fixing devices for connecting said bearing to said chassis frame above and below said elastomer bushing.

3. The chassis according to claim 1, wherein a wheel-set-side bearing includes a bearing bolt pushing vertically through said hydraulic bushing, said bearing bolt having a hole formed therein vertically through said bearing bolt, for guiding fixing devices coaxially through the hydraulic bushing for connecting said bearing to the axle bearing of the wheel set.

4. The chassis according to claim 1, wherein each of said hydraulic bushings has an internal fluid duct hydraulically coupling said externally located fluid chamber and said internally located fluid chamber to the same hydraulic bushing.

5. The chassis according to claim 1, wherein a third wheel set is arranged between the first wheel set and the second wheel set.

6. The chassis according to claim 1, configured for a locomotive.

7. A chassis for a rail vehicle having wheel sets with axles and axle bearings, the chassis comprising:

a chassis frame supported at least on a first wheel set and a second wheel set of the rail vehicle;

an A-arm disposed on each wheel set on both sides of the chassis for horizontally guiding the axle of the wheel set;

a wheel-set-side bearing hinging a respective said A-arm to one of two axle bearings of a wheel set and two frame-side bearings hinging said A-arm to said chassis frame;

said frame-side bearings having elastomer bushings with constant longitudinal and transverse rigidity and said wheel-set-side bearings having hydraulic bushings with constant transverse rigidity and variable longitudinal rigidity;

said frame-side and wheel-set-side bearings of each said A-arm being arranged on corners of a horizontally aligned isosceles triangle, the triangle having a tip forming said wheel-set-side bearing and a base forming said frame-side bearings;

each of said hydraulic bushings having an externally located fluid chamber in a longitudinal direction and an internally located fluid chamber in the longitudinal direction, which are arranged opposite one another in the longitudinal direction and are filled with a hydraulic fluid, each fluid chamber being connected to a fluid duct through which hydraulic fluid can flow into or out of the fluid chamber, wherein the longitudinal rigidity of said hydraulic bushing varies as a function of an excitation frequency of fluid flows forced into or out of a fluid chamber by wheel set guiding forces;

each of said hydraulic bushings having an internal fluid duct hydraulically coupling said externally located fluid chamber and said internally located fluid chamber to the same hydraulic bushing;

a pressure sensor assigned to and coupled with each said fluid chamber via a fluid duct, said pressure sensor responding when a pressure prevailing in the hydraulic fluid falls below a pre-defined threshold value, said pressure sensors being connected individually and/or serially to a pressure monitoring device, and the pressure monitoring device is configured for transmitting a warning signal to a central control device of the rail vehicle when one or all of said pressure sensors respond.

* * * * *